US006445128B1

(12) United States Patent
Bush et al.

(10) Patent No.: US 6,445,128 B1
(45) Date of Patent: Sep. 3, 2002

(54) EL PANEL MADE WITH LOW MOLECULAR WEIGHT PVDF/HFP RESIN

(75) Inventors: Robert L. Bush; P. Kevin Sysak, both of Phoenix, AZ (US)

(73) Assignee: Durel Corporation, Chandler, AZ (US)

( * ) Notice: Subject to any disclaimer, the term of this patent is extended or adjusted under 35 U.S.C. 154(b) by 0 days.

(21) Appl. No.: 09/379,066

(22) Filed: Aug. 23, 1999

(51) Int. Cl.[7] ..... H05B 33/00
(52) U.S. Cl. ..... 313/509; 313/506; 313/504
(58) Field of Search ..... 313/506, 504, 313/503, 509, 512, 511; 106/31.15, 31.24; 428/201

(56) References Cited

U.S. PATENT DOCUMENTS 4,816,717 A 3/1989 Harper et al. ..... 313/502
5,439,705 A 8/1995 Budd ..... 428/403
5,770,920 A * 6/1998 Eckersley et al. ..... 313/506
5,830,028 A * 11/1998 Zovko et al. ..... 445/24
5,882,806 A 3/1999 Mori ..... 428/690
5,988,822 A 11/1999 Abe ..... 359/541
6,005,342 A * 12/1999 Morton ..... 313/486
6,007,927 A 12/1999 Nishikawa et al. ..... 428/690
6,051,343 A 4/2000 Suzuki et al. ..... 429/316
6,129,986 A 10/2000 Bessho et al. ..... 428/421
6,198,216 B1 * 3/2001 Kosa et al. ..... 313/503
6,372,870 B1 4/2002 Kitahara et al. ..... 526/250

* cited by examiner

*Primary Examiner*—Vip Patel
*Assistant Examiner*—Joseph Williams
(74) *Attorney, Agent, or Firm*—Paul F. Wille

(57) ABSTRACT

EL panels are made with PVDF/HFP copolymer resin binder, in substantially an un-crosslinked form, with DMAC solvent and/or other higher boiling point solvents/latent solvents/extenders. The resin binder is characterized by a melt viscosity of 1.0–8.5 kP using an industry standard test (ASTM D3835).

16 Claims, 2 Drawing Sheets

EL PANEL MADE WITH LOW MOLECULAR WEIGHT PVDF/HFP RESIN

BACKGROUND

This invention relates to electroluminescent (EL) lamps and, in particular, to an EL panel made from PVDF/HFP resin. As used herein, an EL "panel" is a single substrate including one or more luminous areas, wherein each luminous area is an EL "lamp".

An EL lamp is essentially a capacitor having a dielectric layer between two conductive electrodes, one of which is transparent. Either the dielectric layer includes a phosphor powder or there is a separate layer of phosphor powder between the dielectric layer and one electrode. The phosphor powder radiates light in the presence of a strong electric field, using very little current.

A modern (post-1990) EL lamp typically includes a transparent substrate of polyester (polyethylene terephthalate, PET) or polycarbonate having a thickness of about 7.0 mils (0.178 mm). A transparent, front electrode of indium tin oxide (ITO) is vacuum deposited onto the substrate to a thickness of 1000 Å or so. A phosphor layer is screen-printed over the front electrode and a dielectric layer is screen-printed over the phosphor layer. A rear electrode is screen-printed over the dielectric layer. A rear insulation layer may be added in the form of a screen-printed layer or a tape with an adhesive coating.

The inks used for screen-printing include a binder, a solvent, and a filler, wherein the filler determines the nature of the printed layer. A typical solvent is dimethylacetamide (DMAC). The binder is typically a fluoropolymer such as polyvinylidene fluoride/hexafluoropropylene (PVDF/HFP), polyester, vinyl, or epoxy. A phosphor layer is typically screen-printed from a slurry (ink) containing a solvent, a binder, and doped zinc sulphide phosphor particles, such as described in U.S. Pat. No. 5,418,062 (Budd). A dielectric layer is typically screen-printed from a slurry (ink) containing a solvent, a binder, and barium titanate (BaTiO3) particles.

A rear (opaque) electrode is typically screen-printed from a slurry (ink) containing a solvent, a binder, and conductive particles such as silver, carbon or graphite, or mixtures thereof. When the solvent and binder for each layer are chemically the same or similar, there is chemical compatibility and good adhesion between adjoining layers. The respective layers are applied, e.g. by screen-printing or roll coating, and then cured or dried.

Thus summarized, the manufacture of EL lamps appears simplicity itself. Unfortunately, there are a few details that complicate the situation. Silver tends to migrate from the rear electrode toward the front electrode, causing black spots or shorts in a lamp. Thus, for higher performance EL lamps, subject to rugged environmental exposure at elevated temperature and humidity, silver is used for bus bars located away from the lamp areas rather than for the rear electrode.

A silver-based rear electrode has a lower resistivity than a carbon-based rear electrode. Thus, eliminating silver tends to limit the area of an EL panel because of non-uniformity in brightness across the face of a large area lamp with a carbon rear electrode. Placing a silver bus bar around the perimeter of a panel helps some but not nearly as much as placing a bus bar across the middle or the longest dimension of a panel. However, the silver from the bus bar will migrate through the rear electrode using the lamp materials of the prior art. Most EL lamps are made in batches by screen-printing rather than being made continuously, e.g. by roll coating. Either way, a layer of material is typically formed as two or three successive layers due to the small amount of resin (binder) dissolved in the ink. It would significantly speed production, and reduce the amount of equipment necessary, if a layer could be formed in a single pass.

Lamps for different applications currently require different materials for the various layers. For example, the specifications for an automotive lamp are quite different from the specifications for a lamp in a wristwatch. The mechanical requirements for an automotive lamp are much more stringent than for a lamp in a wristwatch. For automotive applications, it is desirable that the lamp materials have a high softening temperature. Unfortunately, such materials generally have other characteristics that make them undesirable for EL lamps, e.g. low solubility. Low solubility means that the layer must be formed in several passes and the extra processing steps add to the cost of a panel.

An ITO-coated substrate is temperature sensitive due to shrinkage of the substrate at elevated temperatures. In many lamp panels, the substrate is "pre-shrunk" to stabilize the substrate for subsequent curing operations at high (150° C.) temperature. A low film-forming temperature is therefore highly desirable for avoiding the need to pre-shrink the ITO coated substrate. Many materials with a low film-forming temperature are undesirable for EL lamps because of other characteristics of the materials.

Another problem is adhesion to the substrate in areas where there is ITO present and in other areas where the ITO has been removed. These problems can be overcome by the addition of adhesion promoting agents such as siloxane, e.g. Dow Corning Z6040. It is also known to add an acrylic resin to the ink to improve adhesion. Polymethyl methacrylate polymer (PMMA) and polyethyl methacrylate (PEMA) copolymer are compatible with PVDF-containing resins. The extra processing step of applying or including an adhesion promoter and the added material increase the cost of a panel.

A material that solves any one of the foregoing problems better than existing materials would be most welcome in the art. It has been discovered that a particular type of PVDF/HFP copolymer solves all the foregoing problems.

In view of the foregoing, it is therefore an object of the invention to provide a single construction for EL panels that addresses diverse markets, e.g. automotive, communication, and horology.

Another object of the invention is to provide an ink for making an EL panel wherein a complete layer is formed in a single pass.

A further object of the invention is to provide an EL lamp with a rear electrode containing silver for improved conductivity while exhibiting excellent environmental performance.

Another object of the invention is to provide an ink for making EL panels wherein the ink does not require pretreatment of a preceding layer or the addition of an adhesion promoter to an ink.

A further object of the invention is to provide an ink for EL panels wherein the ink does not require preshrinking of an ITO-coated substrate while retaining excellent high temperature environmental properties.

A further object of the invention is to provide an improved EL lamp in which at least one of the layers of the lamp includes a low molecular weight PVDF/HFP copolymer resin binder.

SUMMARY OF THE INVENTION

The foregoing objects are achieved in this invention in which EL panels are made with PVDF/HFP copolymer resin binder, in substantially an uncrosslinked form, with DMAC solvent and/or other higher boiling point solvents/latent solvents/extenders. The resin binder is characterized by a melt viscosity of 1.0–8.5 kpoise using an industry standard test (ASTM D3835). This viscosity is lower than the viscosity of PVDF/HFP copolymer resins used for other applications in the prior art.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
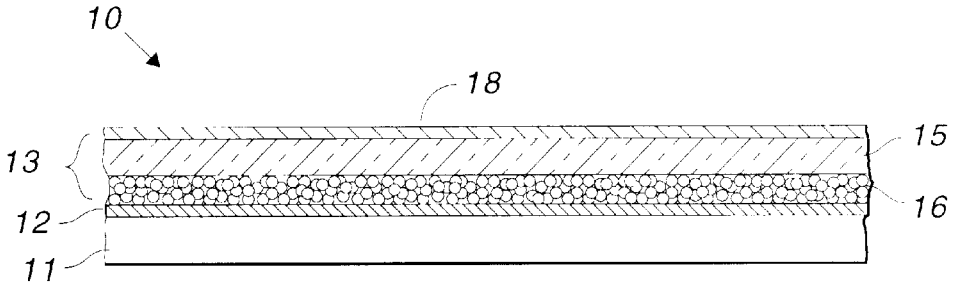
FIG. 1 is a cross-section of an EL lamp constructed in accordance with the invention.

FIG. 1 is a cross-section of an EL lamp constructed in accordance with the invention. The several layers are not shown in proportion or to scale. Lamp 10 includes transparent substrate 11 of polyester or polycarbonate material. Transparent electrode 12 overlies substrate 11 and includes indium tin oxide. Phosphor layer 16 overlies electrode 12 and dielectric layer 15 overlies the phosphor layer. The phosphor layer and the dielectric layer can be combined into a single layer, as indicated by reference number 13. Overlying dielectric layer 15 is rear electrode 18 containing conductive particles such as silver or carbon in a resin binder. Bus bar 19 overlies a position of rear electrode 18.

A layer is produced by dissolving copolymer in a solvent, mixing in filler as appropriate, applying the resulting ink by any suitable means such as screen-printing or roll coating, and then heating the solution to cure (dry) at least partially before applying the next layer. A component to change the boiling point of the solvent and a component to improve the flow of the ink may be added to the ink as required by the chosen processing method for applying the ink.

In one embodiment of the invention, the solvent included about 80% by weight DMAC and, to increase the boiling point, no more than 20% by weight ethylene glycol monobutyl ether acetate. To improve the flow, ethyl acrylate-2-ethylhexyl acrylate co-polymer is added at 0.5 to 1% by weight. A flow modifier aids in the coating process by controlling the Theological properties of the ink and reducing pinholes in the resulting layer. Fewer pinholes means fewer breakdowns in a lamp due to overvoltage.

The phosphor layer includes phosphor particles distributed throughout the mixture in a ratio of 0.5:1 to 4.5:1 by weight (preferably 1.3:1). An insulating, reflective layer includes barium titanate distributed throughout the mixture in a ratio of 0.2:1 to 5:1 by weight, preferably 1.8:1. The mixture includes 5–55%, preferably 35%, by weight PVDF/HFP resin known as "Hylar® SN"™, available from Ausimont USA. Commercially available forms of PVDF/HFP copolymer resin, such as Hylar® resins from Ausimont, Kynar® resins from ELF/Atochem, and Solef® resins from Solvay, are used for making architectural coatings, cable jacketing, and piping for ultra-pure chemicals. As explained more fully below, it has been found that a form of the resin suitable for making EL lamps in accordance with the invention has a lower viscosity, i.e., a lower molecular weight, than the commercially available resins.

Electroluminescent phosphor loading (dry basis) to fluoropolymer binder loading (dry basis) of the resultant final deposited film ranges from 0.5:1 up to 5:1 (preferred is approximately 2.5:1). Dielectric particulate loading, from amongst the following high dielectric fillers, $BaTiO_3$, $TiO_2$, $SrTiO_3$, $CaTiO_3$, etc. (dry basis) to fluoropolymer binder (dry basis) of the resultant final deposited film ranges from 0.5:1 up to 5:1 (preferred is approximately 2:1).

The rear electrodes for some EL panels are made with silver particles dispersed in a binder including fluoropolymer, vinyl, or polyester. The dry weight ratio of silver particles to binder ranges from 2:1 to 5:1 (preferably approximately 3:1). Alternatively, inks containing carbon or graphite particles are used to make the rear electrode for customers demanding low silver migration in an EL panel.

Figure 2:
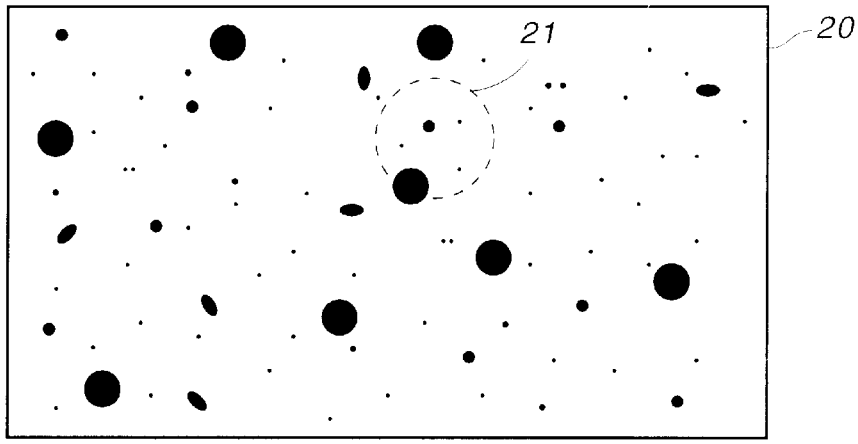
FIG. 2 is a plan view of an EL lamp constructed in accordance with the prior art and subjected to severe environmental testing for twenty-four hours or less.

EL panels constructed in accordance with the invention, using Hylar® SN fluoropolymer as a binder, provided unexpected and impressive results for a silver-based rear electrode or bus bar. EL lamps made with standard fluoropolymer binder and a silver rear electrode typically show black spotting before twenty-four hours of environmental exposure; specifically, continuous operation in an atmosphere at 85° C. and 95% relative humidity. Such a lamp looks like lamp 20 in FIG. 2 except that the edges of the black spots are usually not well defined.

Figure 3:
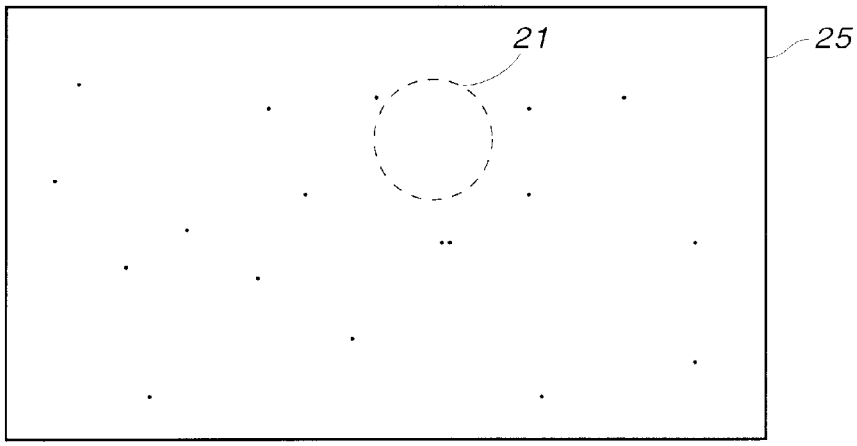
FIG. 3 is a plan view of an EL lamp constructed in accordance with the invention and subjected to severe environmental testing.

Silver migration ultimately results in short circuits between the front electrode and the rear electrode in about forty-eight to seventy-two hours of environmental exposure. The EL panels made with Hylar® SN fluoropolymer showed minimal black spotting for at least three hundred hours. FIG. 3 illustrates the appearance of lamps constructed in accordance with the invention after three hundred hours of testing. These lamps did not short circuit, as all previous EL panels had with a silver rear electrode. As the environmental exposure continued, slow degradation did occur, yet the lamps lasted over twelve hundred hours prior to shorting. This result was unexpected, new, and welcome.

In the following data, brightness must be understood as finding a clear area on a lamp and taking a reading. As illustrated in FIG. 3, such an area, represented by circle 21, is easily found on lamp 25 constructed in accordance with the invention. On lamp 20 (FIG. 2) such an area is less easily found. Even so, the fact remains that lamps constructed in accordance with the prior art shorted and extinguished whereas lamps made in accordance with the invention did not.

EXAMPLE 1

Lamps were constructed identically except for the resin binder. The lamps in Group A were made using Hylar® SN binder and the lamps in Group B were made using ELF/Atochem Kynar® ADS/9301 resin. The lamps were driven identically and continuously at 80 volts, 400 Hz, and subjected to 85° C./95% relative humidity with the following results. The second column for each group is percent of initial luminance.

| Group A | | Group B | |
|---|---|---|---|
| Time (Hrs) | % initial | Time (Hrs) | % initial |
| 0.00 | 100 | 0.00 | 100 |
| 25.58 | 62 | 24.00 | 55 |
| 48.62 | 46 | 49.00 | 33 |
| 71.97 | 36 | 72.00 | 25 |
| 96.55 | 30 | 93.00 | 19 |
| 145.45 | 22 | 169.00 | 11 |
| 199.12 | 17 | | shorted |
| 263.03 | 14 | | |

At the end of the test, the lamps in Group A showed signs of slight (<5–10%) black spotting, with the size of the black spots quite small (<0.25 mm diameter) and none of the lamps shorted. In comparison, Group B showed massive black spotting, with nearly 100% coverage after 72 hours. At that time, the spots were 1–2 mm in diameter, with some very much larger (5 mm). The lamps shorted around 150 hours.

EXAMPLE 2

Another test at slightly lower temperature (65° C.) produced the following results. Except for temperature, all conditions are the same as for Example 1.

| Group A | | Group B | |
|---|---|---|---|
| Time (Hrs) | % initial | Time (Hrs) | % initial |
| 0.00 | 100 | 0.00 | 100 |
| 24.70 | 77 | 27.00 | 69 |
| 47.50 | 67 | 52.00 | 55 |
| 70.88 | 61 | 76.00 | 46 |
| 95.65 | 56 | 97.00 | 39 |
| 143.37 | 47 | 147.00 | 29 |
| 191.52 | 41 | 173.00 | 25 |
| 239.40 | 37 | 216.00 | 21 |
| 310.18 | 32 | | shorted |
| 360.32 | 28 | | |
| 430.37 | 26 | | |
| 503.72 | 23 | | |
| 597.80 | 20 | | |
| 718.20 | 17 | | |
| 838.75 | 15 | | |
| 985.55 | 13 | | |
| 1176.35 | 11 | | |
| 1344.03 | 9 | | |
| 1512.53 | 8 | | |

At the end of the test, the lamps of Group A showed slight spotting (<10%) with small spots but none of the lamps shorted. It was also noticed that the lit area was discolored, beige rather than off-white. The conventional lamps in Group B began spotting between the second reading and the third reading and the lamps shorted after 200+hours. The spotting became massive and nearly 100% by 173 hours. The lit area was brown to gray. This is a difficult test for the lamps and the lamps made according to the invention did very well in comparison with lamps made in accordance with the prior art.

Hylar® SN dissolves at higher weight percents in DMAC solvent than other commercially available PVDF/HFP copolymers, yielding lower solution viscosities at an equivalent weight percent polymer phase. This greatly improves the flow of material during screen-printing or roll coating and enables one to produce a layer in a single pass. An ink made with Hylar® SN resin has a flow characteristic that is similar to Kynar® ADS/9301 resin but has a high temperature/high humidity characteristic similar to resins with much higher melt temperatures.

High solubility is usually associated with low crystallinity and low melting point. However, Hylar® SN has a higher melting point than Kynar® ADS/9301 resin yet has a low percent crystallinity, approximately 12%, enabling the combination of unusually good thermal properties and good solubility properties. Hylar® SN is slightly lower in solubility and similar in crystallinity to Kynar® ADS/9301 resin.

The layers are cured by heating moderately, e.g. approximately 120–125° C. The heat cure yields uniform films of reduced thickness and, most importantly, superior adhesion to the ITO substrate. Adequate adhesion to ITO/PET substrate without using siloxane enables one to make inks in quantity at lower cost. The temperature of the cure is lower than that of high performance resins used in the prior art, such as Kynar® SL/7201 resin. The lower temperature cure causes less discernible shrinkage, allowing tighter dimensional controls to be implemented, and less curl is observed.

Figure 4:
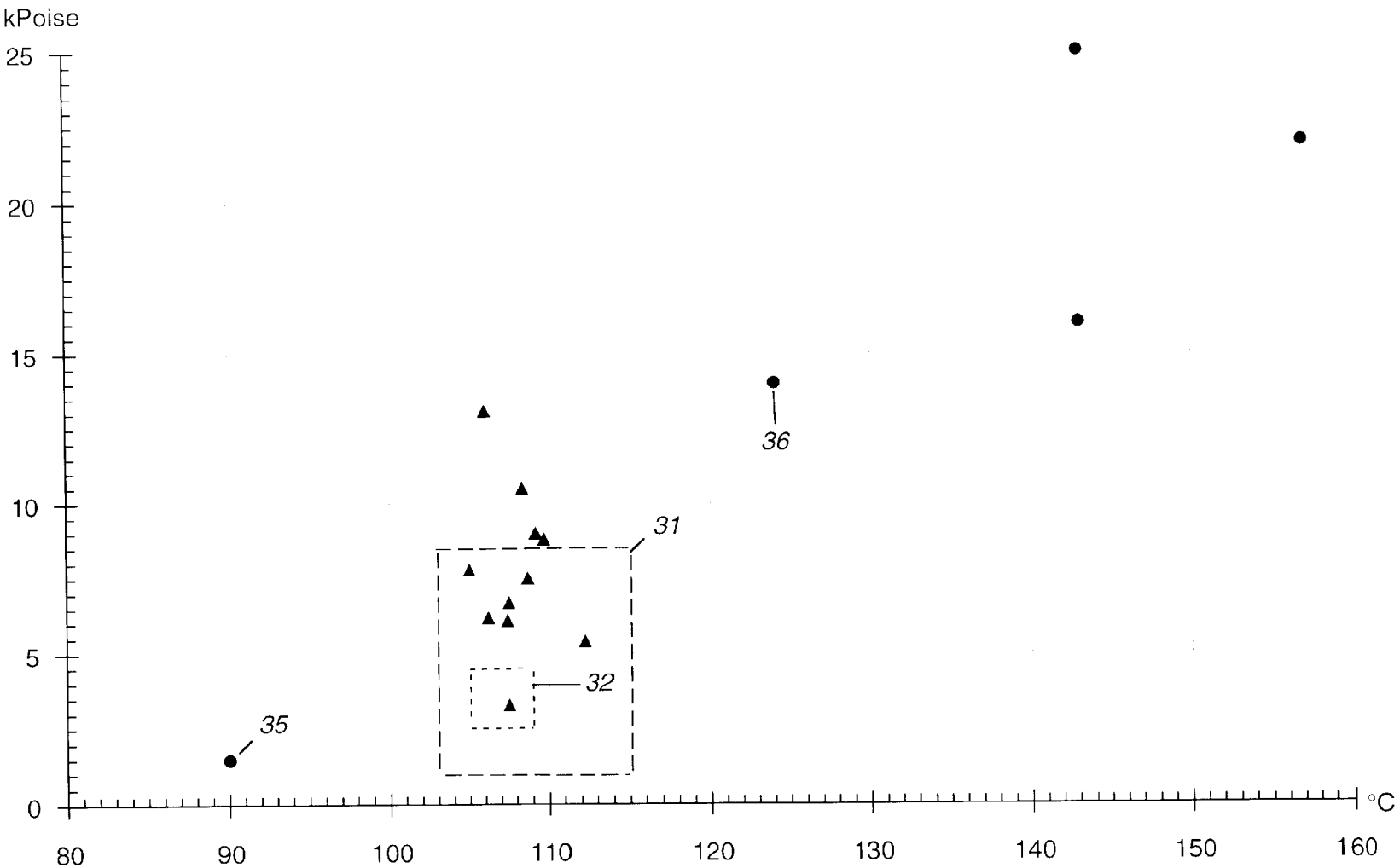
FIG. 4 is a chart of viscosity versus melt temperature for resins used as binders in EL lamps.

FIG. 4 is a chart of melt viscosity (kiloPoise, kP) versus melt temperature (°C.; Differential Scanning Calorimeter (DSC)). Hylar® SN has a melt viscosity range 1–15 kP (D3835). Commercially available PVDF/HFP copolymers for other purposes have a higher melt viscosity than the Hylar® SN found suitable for the manufacture of EL lamps. Specifically, as indicated by rectangle 31, resin having a viscosity of 1.0–8.5 kP and a melt temperature of 103–115° C. is suitable for making EL lamps. A preferred range is 2.5–4.5 kP and 105–109° C., as indicated by rectangle 32.

In FIG. 4, the round dots represent commercially available resins. For example, dot 35 at the lower left-hand corner represents Kynar® ADS/9301 resin, which is suitable for making EL lamps for watches and pagers. This resin is considered unsuitable for making EL panels for automotive use. Dot 36 represents Kynar® SL/7201 resin, which has been used for automotive applications. The triangular shaped dots represent Hylar® SN resins, not all of which are commercially available. The higher molecular weight, higher viscosity PVDF/HFP copolymer resins that are commercially available are used for other purposes, as described above.

At lower melt temperatures, e.g. below 100° C., PVDF/HFP resins become softer, more tacky, eventually becoming elastomeric. At higher temperatures, e.g. above 130–135° C., resins require a pre-shrink of the PET substrate prior to applying and curing the resin. Although an EL lamp could theoretically be made from any resin represented in FIG. 4, some of the lamps would have to be virtually hand made or carefully selected from large batches; i.e. not all the resins are commercially viable. Resins within the larger dashed rectangle are commercially viable and resins within the smaller dashed rectangle are preferred, particularly because such resins can be used for all lamp types.

Several advantages, such as long shelf life, derive from the fact that the Hylar® SN resin ink formulations are not intentionally cross-linked. This does not mean that hardeners cannot be added, e.g. to the dielectric layer or to the phosphor layer of a panel. As known in the art, acrylic resins can be added to harden a resin layer and the Hylar® SN resin is compatible with resins such as PMMA and PEMA.

As known in the art, brightness at a given voltage depends upon the dielectric constant of the binder material. Hylar® SN has a dielectric constant comparable to the best of the fluororesins used in the prior art for EL lamps and better than many copolymer fluororesins.

The following is a preferred embodiment of each layer for an EL panel. Although all three layers use Hylar® SN resin, this is not a requirement. The layers should be considered separate embodiments.

Phosphor Ink and Layer

Combine 17.6 g of Hylar® SN fluororesin, 2 g of Acryloid® B44 acrylic resin, 0.4 g Modaflow® flow modifier, and 41 g of dimethylacetamide solvent. Mix until resins are completely dissolved. Add 39 g of zinc sulfide phosphor with vigorous initial mechanical stirring and several hours of continuous agitation in a closed jar on rollers.

Screen-print this ink on transparent ITO conductor on a polyethylene terephthalate substrate and dry to get a phosphor layer with the approximate composition, by weight: 66% phosphor; 30% fluororesin; 3% acrylic resin; 0.7% Modaflow.

Dielectric/Reflector Ink and Layer

Combine 35.3 g of Ti-Pure® R-700 titanium dioxide, 0.18 g of Disperbyk® 111 surfactant, and 42.7 g of dimethylacetamide with vigorous mechanical stirring until the titanium dioxide is well dispersed. Add 0.44 g of Modaflow® flow modifier and 21.4 g of Hylar® SN fluororesin. Agitate the resulting mixture by continuous rolling in a closed jar until the resin is completely dissolved and a smooth ink is created.

Screen-print the ink on an underlying phosphor layer and dry to get a uniform dielectric/reflector with approximate composition, weight %: 62% titanium dioxide; 37% fluororesin; 0.77% Modaflow; 0.3% Disperbyk 111.

Silver Conductor Ink and Layer

Combine 13 g of Hylar® SN fluororesin, 1.8 g Acryloid® B44 acrylic resin, 0.28 g of Modaflow® flow modifier, and 27 g of dimethylacetamide solvent. Mix until resins are completely dissolved. Add 58 g of Silver Flake #7 (Degussa-Huls Corporation). Shake mixture in closed container on paint shaker until a smooth uniform dispersion is obtained.

Screen-print the ink on an underlying dielectric layer to achieve a uniform conductor layer with approximate dry composition, weight %: 80% silver; 17% fluororesin; 2.6% acrylic resin; 0.4% Modaflow.

The invention thus provides a single construction for EL panels that addresses diverse markets, e.g. automotive, communication, and horology. The ink has a long shelf life because no reactive siloxane is needed and no catalyst is added because the polymer is not cross-linked. A layer can be formed in a single pass without pre-treating the previous layer. One can use silver particles for improved conductivity with minimal migration. The ink does not require preshrinking of an ITO coated substrate.

Having thus described the invention, it will be apparent to those skilled in the art that many modifications can be made with the scope of the invention. For example, other solvents that can be used instead of DMAC include DMF (dimethyl formamide), THF (tetrahydrofuran), DMSO (dimethyl sulfoxide), NMP (N-methyl-2-pyrrolidone), acetone, and mixtures thereof.

What is claimed as the invention is:

1. An EL panel comprising:

a front electrode;

a phosphor layer overlaying said front electrode;

a dielectric layer overlaying said phosphor layer; and a conductive layer overlaying said dielectric layer;

wherein at least one of the layers includes low molecular weight PVDF/HFP copolymer resin.

2. The EL panel as set forth in claim 1 wherein said resin is characterized by a DSC melt temperature of 103–115° C.

3. The EL panel as set forth in claim 1 wherein said resin is characterized by a melt viscosity of 1–8.5 kP.

4. The EL panel as set forth in claim 1 wherein said resin is characterized by a DSC melt temperature of 105–109° C.

5. The EL panel as set forth in claim 1 wherein said resin is characterized by a melt viscosity of 2.5–4.5 kP.

6. The EL panel as set forth in claim 1 wherein said conductive layer includes low molecular weight PVDF/HFP resin.

7. The EL panel as set forth in claim 6 wherein said conductive layer includes with silver particles dispersed therein.

8. The EL panel as set forth in claim 6 wherein said conductive layer includes with carbon particles dispersed therein.

9. The EL panel as set forth in claim 8 and further including a bus bar containing silver particles and overlying said conductive layer.

10. The EL panel as set forth in claim 9 wherein said bus bar surrounds at least one lit area of said panel.

11. The EL panel as set forth in claim 9 wherein said bus bar overlies at least a portion of a lit area.

12. The EL panel as set forth in claim 6 wherein at least one of said dielectric layer and said phosphor layer includes low molecular weight PVDF/HFP resin.

13. An EL panel comprising:

a front electrode;

a phosphor layer overlying said front electrode;

a dielectric layer overlying said phosphor layer; and a conductive layer overlying said dielectric layer;

wherein at least one of the layers includes a low molecular weight resin characterized by a DSC melt temperature of 103–115° C. and characterized by a melt viscosity of 1–8.5 kP.

14. The EL panel as set forth in claim 13 wherein said resin characterized by a DSC melt temperature of 105–109° C. and characterized by a melt viscosity of 2.5–4.5 kP.

15. The EL panel as set forth in claim 13 wherein said conductive layer includes silver particles dispersed therein.

16. The EL panel as set forth in claim 15 wherein said conductive layer includes PVDF/HFP copolymer.

* * * * *